US005901413A

United States Patent [19]

Patee

[11] Patent Number: 5,901,413

[45] Date of Patent: May 11, 1999

[54] VERTICAL BLIND HOLDER APPARATUS

[76] Inventor: John C. Patee, 11440 Flint St., Platte City, Mo. 64079

[21] Appl. No.: 08/853,568

[22] Filed: May 9, 1997

[51] Int. Cl.[6] ..... A47B 95/02

[52] U.S. Cl. ..... 16/87 R; 160/349.2; 16/124; 16/115; 16/111 R

[58] Field of Search ..... 16/87.2, 111 R, 16/114 R, 124, 87 R, 115; 160/178 IV, 340, 341, 349.2; 49/460

[56] References Cited

U.S. PATENT DOCUMENTS

| | | | |
|---|---|---|---|
| 2,219,253 | 10/1940 | Cunningham | 160/349.2 |
| 2,713,897 | 7/1955 | Teague et al. | 16/124 |
| 3,514,904 | 6/1970 | Riegelman | 16/111 R |
| 3,676,895 | 7/1972 | Stewart | 16/110 R |
| 3,866,659 | 2/1975 | Kaminski | 160/349.2 |
| 4,817,239 | 4/1989 | Campbell et al. | 16/124 |
| 4,903,370 | 2/1990 | Erdmann | 16/87.2 |
| 4,911,575 | 3/1990 | Tidwell | 16/114 R |
| 5,040,266 | 8/1991 | Hochen | 16/87.2 |
| 5,428,867 | 7/1995 | Hannerstig | 16/87.2 |
| 5,517,722 | 5/1996 | Bender | 26/87.2 |
| 5,529,357 | 6/1996 | Hoffman | 16/114 R |

*Primary Examiner*—Chuck Y. Mah
*Assistant Examiner*—Donald M. Gurley
*Attorney, Agent, or Firm*—Henderson & Sturm

[57] ABSTRACT

A vertical blind holder apparatus 10 for collecting, gathering, and moving individual vertical blind panel segments away from an opening created by a sliding glass door 40. The apparatus 10 comprises an extension unit 20 which extends rearwardly from, and is operatively connected to the handle grip portion 53 of the handle member 50 of the sliding glass door 40 to collect the individual vertical blind panel segments 101 as the sliding glass door 40 is opened.

9 Claims, 2 Drawing Sheets

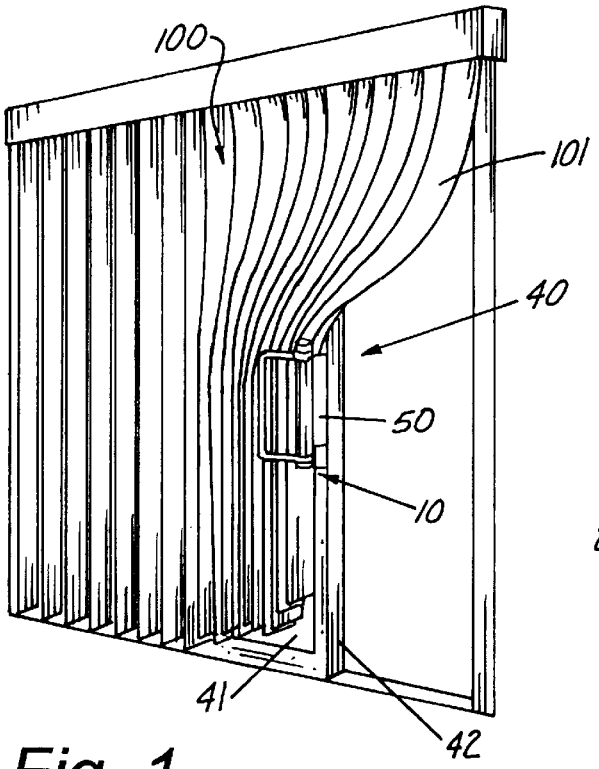
Fig. 1
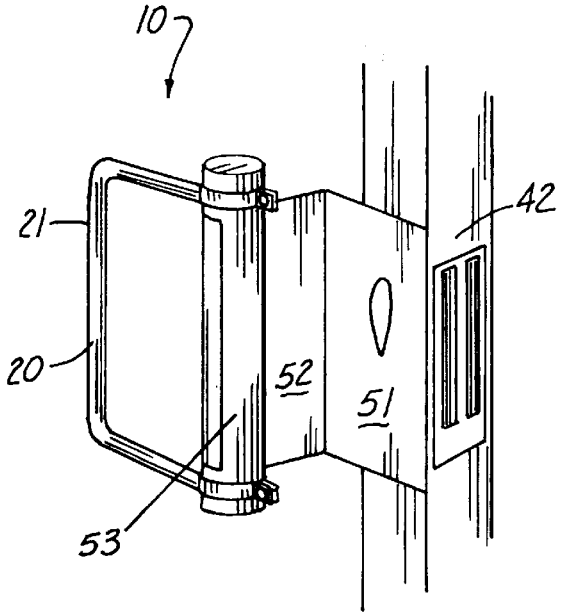
Fig. 2
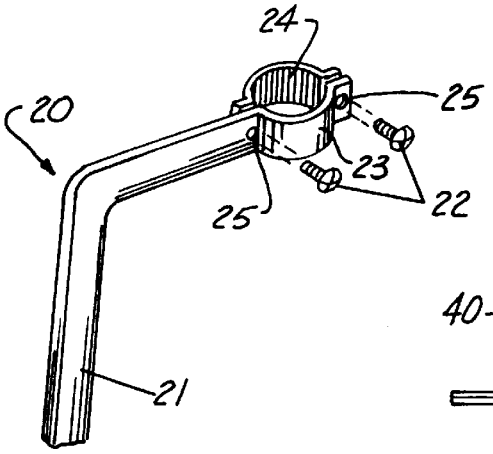
Fig. 3
Fig. 4
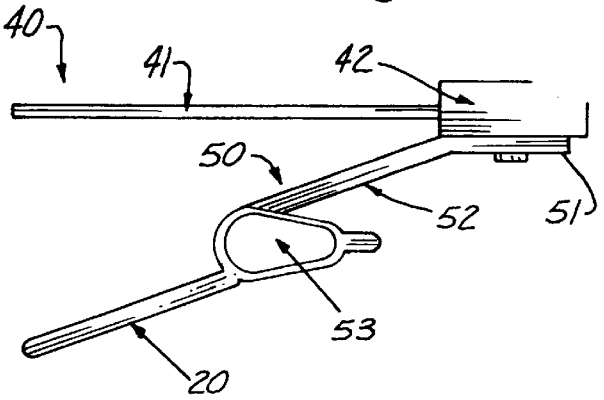

VERTICAL BLIND HOLDER APPARATUS

BACKGROUND OF THE INVENTION

1. Field of the Invention

The present invention relates to the field of curtain gathering devices in general, and in particular to a gathering device for use on sliding glass doors to gather vertical blind panels.

2. Description of Related Art

As can be seen by reference to the following U.S. Pat. Nos. 4,903,370; 5,040,266; 5,428,867; and 5,517,722, the prior art is replete with myriad and diverse curtain gathering or holding devices.

While all of the aforementioned prior art constructions are more than adequate for the basic purpose and function for which they have been specifically designed, they are uniformly deficient with respect to their failure to provide a simple, efficient, and practical device for temporarily gathering vertical blinds in the vicinity of a sliding glass door.

As anyone who is familiar with vertical blind construction can readily attest, there is no current practical solution for dealing with the vertical blind panels in the vicinity of sliding glass doors other than to retract the blinds a substantial distance beyond the opening created by the door to prevent the blind panels from rattling against one another due to the passage of wind through the door opening.

As a consequence of the foregoing situation, there has existed a longstanding need for a new and improved sliding glass door construction that incorporates therein a vertical blind holder apparatus that gathers and restrains the vertical blind panels that are normally suspended across the opening formed by the door. The provision of such a construction is a stated objective of the present invention.

BRIEF SUMMARY OF THE INVENTION

Briefly stated, the vertical blind holding apparatus that forms the basis of the present invention comprises an extension unit operatively associated with the handle on a conventional sliding glass patio door. The extension unit cooperates with sliding glass door handles to gather the individual vertical blind panel segments as the sliding door is opened.

As will be explained in greater detail further on in the specification, in the preferred embodiment of the invention the extension unit comprises an after-market add-on member which extends outwardly and rearwardly relative to the existing handle member and which may be selectively angularly disposed relative to the handle member. Furthermore, the member is provided with a generally C-shaped configuration such that the opening in the member permits unimpeded access of the user's hand with respect to the handle member.

In addition, in a before-market alternate version of the invention, the extension unit would be formed integrally with the grip portion of the handle member.

BRIEF DESCRIPTION OF THE SEVERAL VIEW OF THE DRAWING

These and other attributes of the invention will become more clear upon a thorough study of the following description of the best mode for carrying out the invention, particularly when reviewed in conjunction with the drawings, wherein:

FIG. 1 is a perspective view of the vertical blind holder apparatus installed on a conventional sliding glass door assembly;

FIG. 2 is an isolated perspective view of the apparatus installed on a sliding glass door handle member;

FIG. 3 is an enlarged detail view of one securing mechanism that can be employed in conjunction with the apparatus;

FIG. 4 is a top plan view of an alternate version of the preferred embodiment;

DETAILED DESCRIPTION OF THE INVENTION

Figure 5:
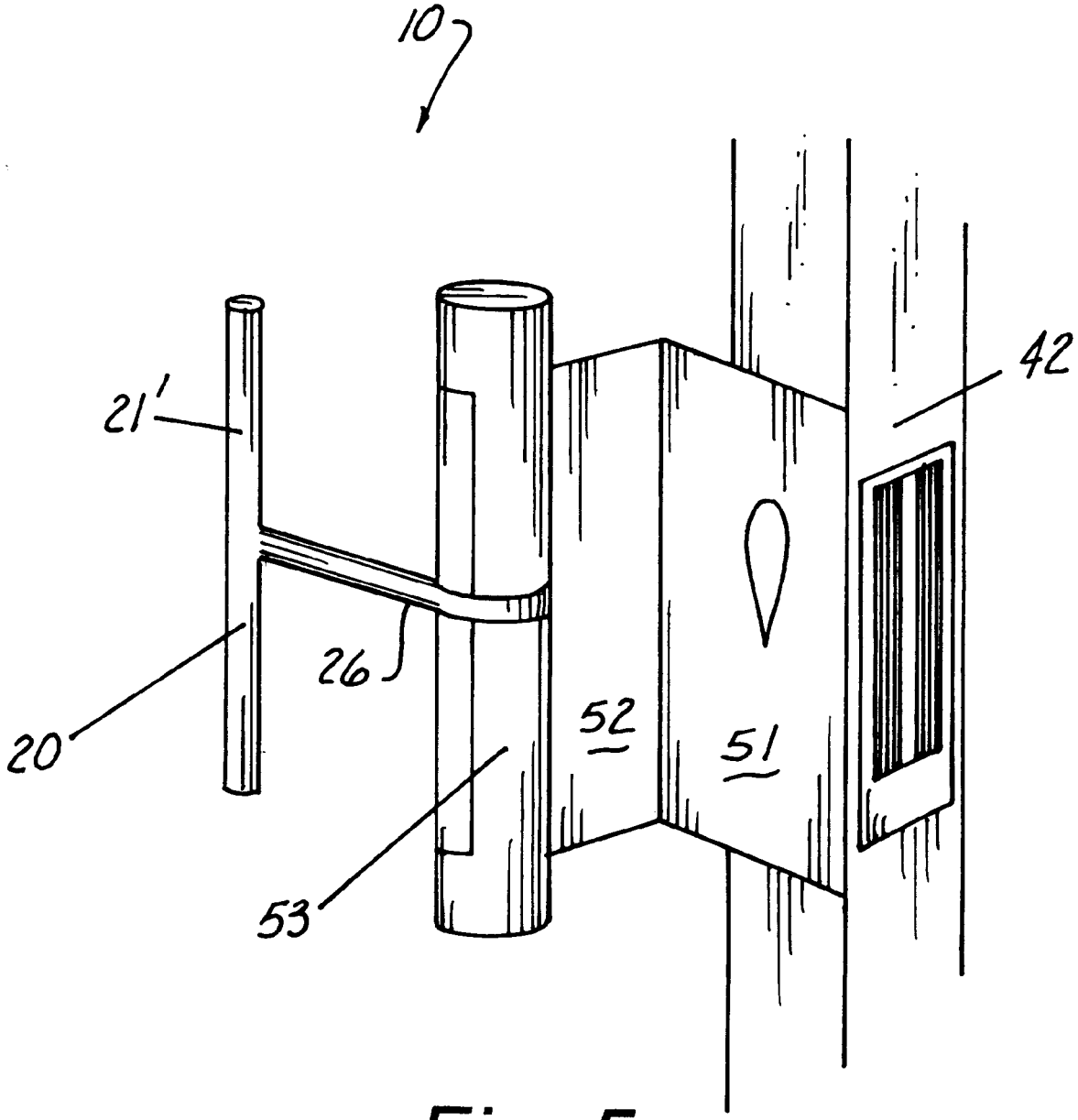
FIG. 5 is an isolated perspective view of an alternate version of the apparatus installed on a sliding glass door handle member.

As can be seen by reference to the drawings, and in particularly to FIG. 1, the vertical blind holder apparatus that forms the basis of the present invention is designated generally by the reference number 10. The apparatus 10 is designed and intended to be used in conjunction with the handle member 50 on a conventional sliding glass door assembly designated generally as 40 to captively engage, gather, and collect the individual panel segments 101 of a set of vertical blinds 100.

As shown in FIGS. 1 and 4, the sliding glass door assembly 40 comprises in general at least one pane of glass 41 surrounded by a door frame 42 which is provided with a handle member 50. The handle member 50 comprises in general, a mounting bracket 51 which is secured to the door frame 42 and is provided with an extension arm 52 which is connected to the hand grip element 53 of the handle member 50 in a well recognized fashion.

In the after-market version of the invention illustrated in FIGS. 1 through 3, the vertical blind holder apparatus 10 comprises in general, an extension unit 20 operatively connected to, and projecting outwardly and rearwardly from, the hand grip element 53 of the handle member 50.

The extension unit 20 comprises in general, a generally C-shaped bracket member 21 secured on its inboard end to the upper and lower portions of the hand grip element 53 of the handle member 50 by a bracket comprising a plurality of fastener elements 22.

As can best be seen by reference to FIGS. 2 and 3, each end of the member 21 is provided with a bracket comprising a an arcuate portion 23 dimensioned to receive a portion of the hand grip element 53 and an arcuate clamp element 24. In addition, both the bracket member 21 and the clamp element 24 are provided with a plurality of discrete apertures 25 which are dimensioned to receive the fastener elements 22 to operatively engage the extension unit 20 to the hand grip element 53 in a well recognized fashion.

As can also be seen by reference to FIG. 5 in an alternate embodiment of the market version of the invention, the extension unit 20 comprises a generally T-shaped member 21' wherein the inboard end of the stem 26 of the member 21' is provided with a fastening arrangement similar to that employed on inboard ends of the C-shaped member 21.

Turning now to FIG. 4, it can be seen that in the before-market version of this invention, the extension unit 20 will be formed integrally with the handle grip element of the handle member 50 and may include either the C-shaped or T-shaped configurations depicted in FIGS. 2 and 5.

In all of the versions described herein, the extension unit 20 will collect, gather, and physically move the individual vertical blind panel segments 101 away from the opening created by the movement the sliding glass door 40 without the need to retract the vertical blind assembly 100 prior to opening the door 40.

In addition, the only real distinction between the before-market and after-market versions of this invention is the ability of the user to vary the angular orientation of the after-market version relative to the handle grip element 53 to suit their personal tastes.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

I claim:

1. A vertical blind holder apparatus for use in combination with a sliding glass door and vertical blind arrangement wherein the sliding glass door is provided with a handle member having a handle grip element and the vertical blind includes a plurality of individual vertical blind panel segments suspended adjacent the sliding glass door; wherein, the vertical blind holder apparatus comprises:

an extension unit operatively associated with and projecting rearwardly in a door opening direction from said handle grip element wherein the extension unit is formed integrally with said handle grip element.

2. The improvement as in claim 1 wherein said extension unit has a generally U-shaped configuration.

3. The improvement as in claim 1 wherein said extension unit has a generally T-shaped configuration.

4. A vertical blind holder apparatus for use in combination with a sliding glass door having a vertical blind arrangement wherein the sliding glass door is provided with a handle member having a handle grip element and the vertical blind includes a plurality of individual vertical blind panel segments suspended adjacent the sliding glass door; wherein the vertical blind holder apparatus comprises:

an extension unit having means for releasable connection to said handle grip element and capable of being disposed in an outward and rearward door opening direction from said handle grip element; wherein the orientation of the extension unit is angled generally in the direction of said vertical blind segments to captively engage the blind segments as the sliding glass door is opened.

5. The apparatus as in claim 4 wherein the extension unit is releasably and adjustably connected relative to the handle grip element.

6. The apparatus as in claim 4 wherein said releasable connection means includes a bracket member connected to said handle grip element.

7. The apparatus as in claim 6 wherein the bracket member is provided with at least one arcuate portion, an arcuate clamp element which cooperate with one another and with fastening elements to operatively connect the bracket member to the handle grip element.

8. The apparatus as in claim 6 wherein the extension unit has a generally U-shaped configuration.

9. The apparatus as in claim 6 wherein the extension unit has a generally T-shaped configuration.

* * * * *